United States Patent [19]

Graham

[11] 4,174,658

[45] Nov. 20, 1979

[54] TRAY FORMER

[75] Inventor: Robert H. Graham, Spokane, Wash.

[73] Assignee: R. A. Pearson Company, Spokane, Wash.

[21] Appl. No.: 875,230

[22] Filed: Feb. 6, 1978

[51] Int. Cl.[2] ..... B31B 3/26

[52] U.S. Cl. ..... 93/51 HW; 93/49 R

[58] Field of Search ..... 93/51 R, 51 HW, 51 M, 93/47, 49 R

[56] References Cited

U.S. PATENT DOCUMENTS

| | | | |
|---|---|---|---|
| 586,803 | 7/1897 | Taylor | 93/51 R |
| 1,808,014 | 6/1931 | Bergstein | 93/51 R X |
| 2,820,403 | 1/1958 | Plough et al. | 93/51 HW |
| 3,218,940 | 11/1965 | Pearson | 93/51 R |
| 3,640,189 | 2/1972 | Bowman | 93/51 HW X |
| 3,763,749 | 10/1973 | Sawada | 93/51 R |

*Primary Examiner*—James F. Coan

*Attorney, Agent, or Firm*—Wells, St. John & Roberts

[57] ABSTRACT

An improvement in a carton forming mechanism of the type wherein a mandrel is reciprocated through a die assembly to fold the side walls and tabs of an upwardly open carton assembly having perpendicular pairs of side walls. It is designed specifically for carton blanks having protruding tabs at the ends of both pairs of side walls, so that each side wall is overlapped by a bent tab when the carton is completed. The folding mechanism includes two opposed pairs of folding irons mounted about parallel spaced pivot axes. Each folding iron has an arcuate surface to fold a first carton wall relative to the bottom carton wall. It also includes a radial extension at the outermost edge of the arcuate surface for folding a first tab relative to the first wall. Radial spacing is provided on each folding iron between the arcuate surface and the shaft mounting it. This spacing is sufficient to permit second tabs at the ends of second side walls of the carton perpendicular to the folded first side walls to pass between the pivot shafts without interference. A pair of pressure rollers are rotatably mounted about parallel axes perpendicular to the pivot axes and at an elevation below that of the folding irons, whereby the second carton side walls are folded along their score lines common to the bottom carton wall as each blank is forced between the rollers by reciprocation of the mandrel. In the resulting partially-folded carton condition, the second tabs remain extended for subsequent completion of the carton.

4 Claims, 7 Drawing Figures

TRAY FORMER

BACKGROUND OF THE INVENTION

This invention relates to a machine for folding upwardly open cartons during reciprocation of a mandrel through a die assembly. The general nature of this type of machine is set out in U.S. Pat. No. 3,218,940 to Pearson, issued Nov. 23, 1965. The disclosure of this patent is herein incorporated by reference.

In the type of forming apparatus shown in U.S. Pat. No. 3,218,940 folding irons are located in opposition to one another for engagement at opposite sides of a carton blank forced between them. Each folding iron projects into the path of the carton bottom wall of each blank. Movement of the mandrel pivots the folding irons about their respective pivot axes. This apparatus is designed for conventional single thickness trays or carton blanks, having only a single set of end tabs which are folded about the upright corners of the tray or blank as it is formed and glued.

Many tray blanks, particularly those used for certain types of fresh produce, have double walls along one side and overlapping sets of tabs at each corner. However, such blanks cannot be moved through the die assembly shown in the prior Pearson U.S. Pat. No. 3,218,940, without the tabs being torn from the blanks by interference of the pivot shafts that support the folding irons.

The present invention was developed to remedy this problem and to provide a relatively simple mechanism by which tabs along one pair of side walls can be folded without this folding mechanism interfering with free passage of the remaining pair of side walls and extending tabs formed thereon. The details of this mechanism are shown in the drawings and described below.

DESCRIPTION OF THE PREFERRED EMBODIMENT

Figure 6:
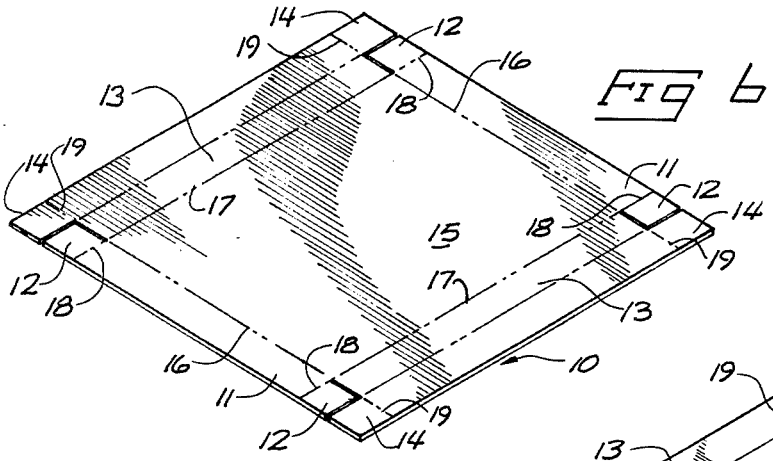
FIG. 6 is a perspective view of a carton blank.
Figure 7:
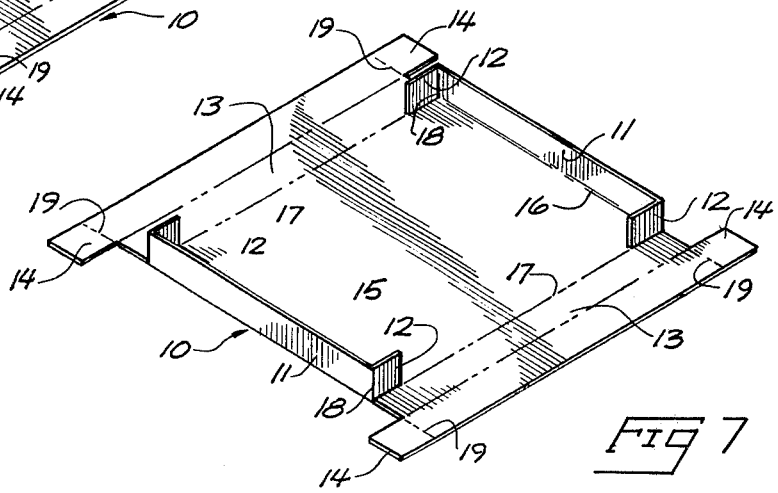
FIG. 7 is a perspective view of the partially folded carton.
Figure 4:
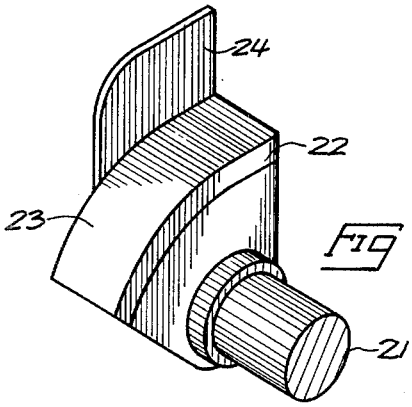
FIG. 4 is a fragmentary perspective view of a folding iron.
Figure 5:
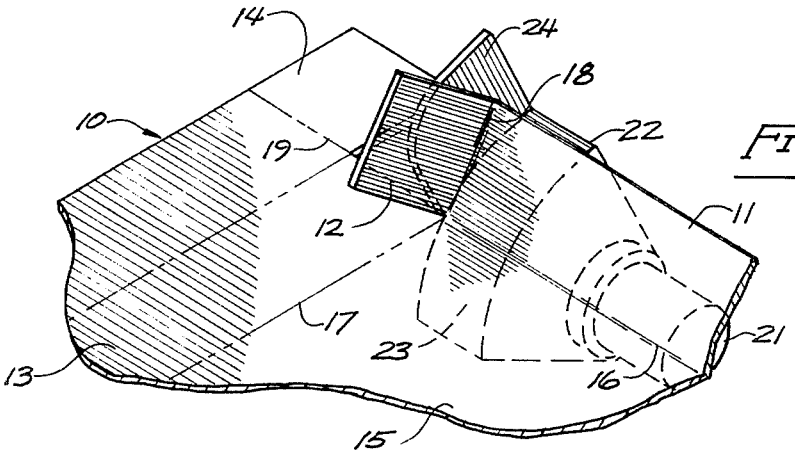
FIG. 5 is a fragmentary perspective view showing operation of a folding iron.

The drawings show the essential details of the modification made in the folding mechanism for cartons of the type shown in FIGS. 6 and 7. The mechanism relates to a machine for folding carton blanks 10 having first and second pairs of perpendicular side walls 11, 13. Each side wall 11 is joined to the central bottom carton wall 15 along parallel score lines 16. The outer ends of each side wall 11 have a pair of protruding tabs 12 joined thereto by score lines 18. These first scored tabs are formed on the first side walls 11 so as to be adapted to be folded perpendicular to walls 11 for engagement by the inner surfaces of the subsequently folded second pair of side walls 13.

The second side walls 13 each have two tabs 14 projecting at their respective ends. The second side walls 13 are formed as double walls which are ultimately folded against one another or are perpendicular. The second side walls 13 are joined to the bottom carton wall 15 along score lines 17. Second tabs 14 are joined to walls 13 along score lines 19. The second tabs 14 are adapted to be subsequently folded perpendicular to the second side walls 13 in engagement with the first pair of side walls 11. This final step is done by hand or by machinery outside the scope of this disclosure. In this way, the corners of the resulting carton are ultimately reinforced by folded tabs integral with each pair of side walls with the tabs on one pair of side walls respectively glued to a side wall of the remaining pair.

The carton blank 10 is forced through the folding mechanism by a reciprocating mandrel 30, typically powered by a conventional hydraulic cylinder (not shown) directly coupled to it. The mandrel 30 includes perpendicular side walls 31, 32 adapted to be engaged by the respective side walls 11, 13 of the carton blank. The mandrel in general has a size and shape conforming to the interior of a formed carton. The folding mechanism shown in the drawings is complementary to the mandrel and has surfaces spaced outwardly from the moving mandrel surfaces a distance sufficient to receive the thickness of the respective carton walls and tabs.

The folding mechanism is mounted on a fixed supporting framework 20. A pair of parallel pivot shafts 21 are respectively supported on framework 20 by bearings 27. The shafts 21 are pivotally supported by bearings 27 about parallel spaced axes lying in a common horizontal plane perpendicular to the direction of movement of the mandrel 30. The spacing between the pivot shafts 21 is slightly greater than the combined length of each second side wall 13 of the carton blank plus the width of the second tabs 14 extending therefrom. In other words, the extended tabs 14 can freely pass between the pivot shafts 21 without physical interference.

Two opposed pairs of folding irons 22 are located respectively along pivot shafts 21. Each folding iron 22 is fixed to the pivot shaft which supports it, and therefore moves in unison with the shaft 21 about the shaft pivot axis. Each folding iron 22 includes an upwardly and inwardly facing arcuate surface 23 generated about the pivot axis of its supporting shaft 21. Arcuate surfaces 23 fold the first carton walls 11 along their score lines 16 common to the bottom carton wall 15.

Each folding iron 22 further includes a radial extension 24 at the outermost edge of its arcuate surface 23. The extension 24 projects outward beyond the periphery of the surface 23 and serves to fold a first tab 12 along its score line 18 common to the first carton side wall 11. Tab 12 is folded simultaneously with the folding of the side walls 11.

Figure 1:
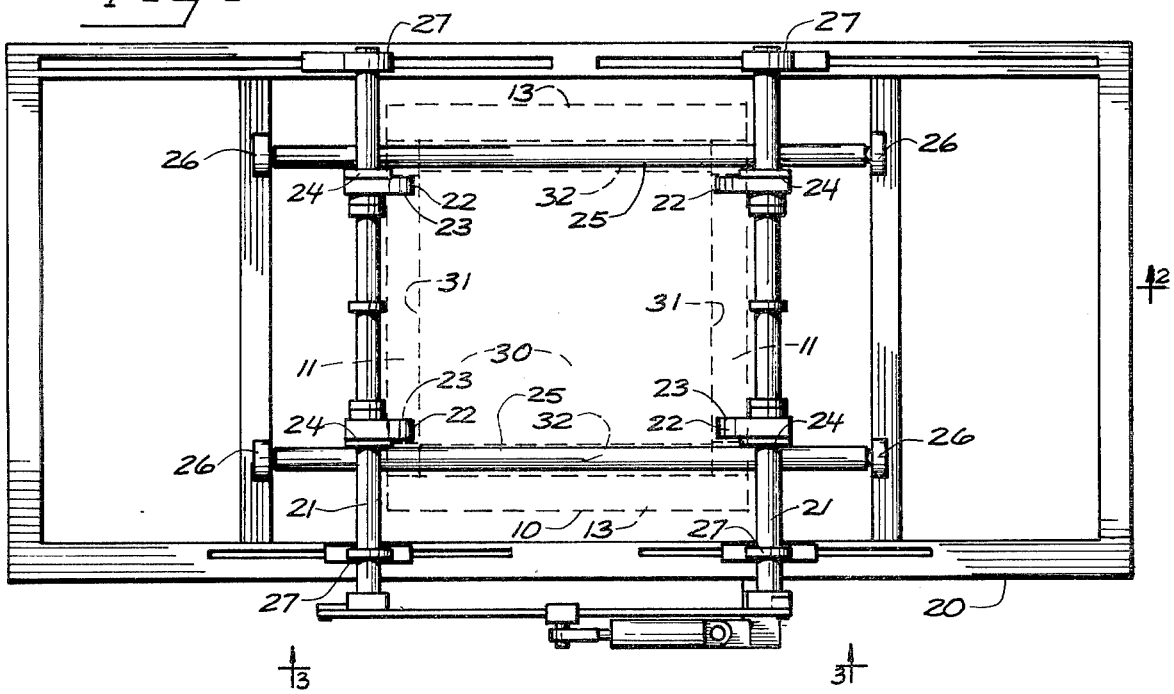
FIG. 1 is a plan view looking at the tray forming mechanism.
Figure 2:
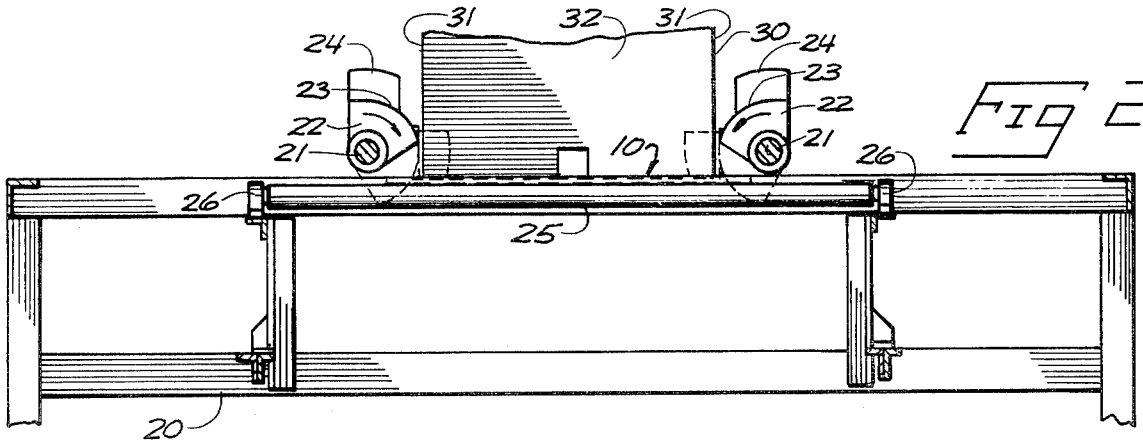
FIG. 2 is a sectional view taken along line 2—2 in FIG. 1.
Figure 3:
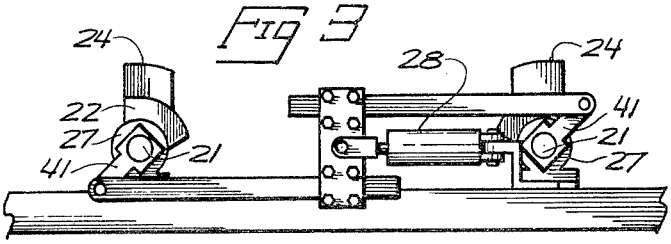
FIG. 3 is a fragmentary elevational view along line 3—3 in FIG. 1.

The pivot shafts 21 are moved about the spaced pivot axes by a common cylinder assembly 28, (FIG. 3) connected between the framework 20 and crank arms 41 on each shaft 21. This connection is illustrated by parallel bars 30. Extension or retraction of the cylinder assembly 28 simultaneously pivots the two shafts 21 in opposite directions about their respective axes. Movement of the shafts 21 is timed with respect to the reciprocating movement of mandrel 30 by conventional control devices (not shown).

A pair of pressure rollers 25 are rotatably mounted on framework 20 at an elevation below that of the folding irons 22. The rollers 25 are journalled about parallel spaced roller axes perpendicular to the pivot axes of shafts 21. They are supported on framework 20 by bearings 26. Rollers 25 are spaced apart from one another by a distance substantially equal to the width of the first carton side walls 11. The pressure rollers 25 fold the second carton side walls 13 along their score lines 17 as each carton blank 10 is forced between the rollers 25 by reciprocation of mandrel 30. They also act in opposition to the side walls 32 of mandrel 30 to exert pressure between the first tabs 12 and the inner surfaces of side walls 13 to set the adhesive which normally is applied to their abutting surfaces before folding of the carton blank.

The partially folded carton blank then emerges from the lower end of the foldng mechanism with walls 11 and 13 folded upwardly. The second tabs 14 still project outwardly from the second side walls of the carton and must be folded by subsequent machinery operation.

This improvement can be applied to many types of folding mechanisms for upwardly open carton blanks or partially folded blanks which are produced by forcing the blank between a mandrel and die. For this reason, only the following claims are intended to set out the scope of the disclosed invention.

Having described my invention, I claim:

1. In a carton forming machine for carton blanks having:

a central bottom wall bounded by first and second pairs of scored side walls each adapted to be folded perpendicular to the bottom wall;

said first pair of side walls having first scored tabs formed at each end thereof, said first tabs being adapted to be folded perpendicular to the side walls on which they are formed for engagement by the folded second pair of side walls;

said second pair of side walls having second scored tabs formed at each end thereof, said second tabs being adapted to be folded perpendicular to the side walls on which they are formed for engagement by the folded first pair of side walls;

a folding machanism complementary to a reciprocating mandrel conforming to the interior of a formed carton, comprising:

two opposed pairs of folding irons located respectively along parallel spaced pivot axes, said folding irons including arcuate surfaces generated about their respective pivot axes and adapted to told the first pair of side walls along their score lines common to the bottom wall of each carton blank;

each folding iron further including a radial extension at the outermost edge of its arcuate surface for folding a first scored tab relative to a first side wall;

means supporting the folding irons for pivotal motion about said parallel spaced pivot axes;

the spacing between the spaced pivot axes being greater than the combined lengths of one second side wall and the second scored tabs extending therefrom;

a pair of pressure rollers at an elevation below that of the folding irons, said rollers being journalled about parallel spaced roller axes which are perpendicular to the parallel spaced pivot axes, said rollers spanning the full distance separating the pivot axes and having a minimum separation between them substantially equal to the width dimension of the first carton walls between the second side walls, whereby the second side walls are folded along their score lines common to the bottom wall as each carton blank is forced between the rollers by reciprocation of the mandrel.

2. The mechanism as defined by claim 1 wherein the means for supporting the folding irons for pivotal movement is comprised of a cylinder assembly operatively interconnecting the folding irons for pivoting the folding irons simultaneously and in opposite directions about the pivot axes.

3. In a carton forming machine for carton blanks having:

a central bottom wall bounded by first and second pairs of scored side walls each adapted to be folded perpendicular to the bottom wall;

said first pair of side walls having first scored tabs formed at each end thereof, said first tabs being adapted to be folded perpendicular to the side walls on which they are formed for engagement by the folded second pair of side walls;

said second pair of side walls having second scored tabs formed at each end thereof, said second tabs being adapted to be folded perpendicular to the side walls on which they are formed for engagement by the folded first pair of side walls;

a folding mechanism complementary to a reciprocating mandrel conforming to the interior of a formed carton, comprising:

a supporting framework;

a pair of pivot shafts journalled on said framework about spaced parallel pivot axes lying in a common horizontal plane, the separation between the shafts being greater than the combined length of one of the second side walls plus the widths of the second scored tabs extending therefrom;

a pair of opposed folding irons fixed on each of said pivot shafts, each folding iron including an upwardly and inwardly facing arcuate surface generated about the pivot axis of the shaft on which it is fixed and adapted to fold the first carton side walls along their score lines common to the wall of the carton blank;

each folding iron further including a radial extension at the outermost edge of its arcuate surface for folding the first tabs along their score lines common the respective first side walls;

the radial spacing between each arcuate surface and the pivot shaft on which it is mounted at a position adjacent the radial extension associated therewith being greater than the width of the second scored tabs;

a pair of pressure rollers at an elevation below that of the folding irons, said rollers being journalled about parallel spaced roller axes which are perpendicular to the parallel spaced pivot axes, said rollers spanning the full distance separating the pivot axes and having a minimum separation between them substantially equal to the width dimension of the first carton side walls between the second side walls, whereby the second carton side walls are folded along their score lines common to the bottom wall as each carton blank is forced between the rollers by reciprocation of the mandrel.

4. The mechanism as defined by claim 3 further comprising a cylinder assembly connected between the framework and pivot shafts for pivoting the folding irons in opposite directions about the pivot axes.

* * * * *